US008228289B2

(12) United States Patent
Nagasaki

(10) Patent No.: US 8,228,289 B2
(45) Date of Patent: Jul. 24, 2012

(54) DISPLAY DEVICE AND TIMEPIECE

(75) Inventor: Shintaro Nagasaki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 1106 days.

(21) Appl. No.: 11/802,896

(22) Filed: May 25, 2007

(65) Prior Publication Data

US 2007/0296690 A1 Dec. 27, 2007

(30) Foreign Application Priority Data

Jun. 23, 2006 (JP) ..... 2006-173412

(51) Int. Cl.
*G09G 3/34* (2006.01)

(52) U.S. Cl. ..... 345/107

(58) Field of Classification Search ..... 345/107
See application file for complete search history.

(56) References Cited

U.S. PATENT DOCUMENTS

| | | | | |
|---|---|---|---|---|
| 2002/0101433 | A1* | 8/2002 | McKnight | 345/589 |
| 2005/0001812 | A1* | 1/2005 | Amundson et al. | 345/107 |
| 2006/0023126 | A1* | 2/2006 | Johnson | 349/1 |
| 2006/0050050 | A1* | 3/2006 | Zhou et al. | 345/107 |
| 2007/0052665 | A1* | 3/2007 | Zhou et al. | 345/107 |
| 2007/0085819 | A1* | 4/2007 | Zhou et al. | 345/107 |

FOREIGN PATENT DOCUMENTS

JP S52-070791 6/1977

* cited by examiner

*Primary Examiner* — William Boddie
*Assistant Examiner* — Dorothy Harris
(74) *Attorney, Agent, or Firm* — Global IP Counselors, LLP

(57) ABSTRACT

A display device having an electrophoretic display panel that has two types of electrophoretic elements of different color and polarity disposed between electrodes, and changes display state according to an applied voltage, and a drive means for driving the electrophoretic display panel by applying a voltage between the electrodes. The drive means has a storage means for storing color transition information correlating the color levels displayed by the electrophoretic elements to the color level that is displayed when a positive pulse is applied and the color level that is displayed when a negative pulse is applied to the electrode connected to the electrophoretic elements displaying a particular color level; a target value setting means for setting as a target value the color level to be displayed by the electrophoretic elements; and a pulse applying means for applying a pulse of a specific voltage level to the electrode at least until a current value denoting the current color level of the electrophoretic elements matches the target value. The pulse applying means has a value determination unit for determining if the current value and the target value match, a pulse application unit for applying either a positive pulse or a negative pulse to the electrode so that the current value approaches the target value if the value determination unit determines the current value and the target value do not match, a transition value acquisition unit for getting from the color transition information a transition value denoting the color level after the pulse is applied, and a current value updating unit for updating the current value to the transition value.

7 Claims, 14 Drawing Sheets

| PULSE COUNT | 0 | 1 | 2 | 3 | 4 | 5 | 6 | 7 |
|---|---|---|---|---|---|---|---|---|
| WHITE → BLACK | 0.35 | 0.51 | 0.78 | 1.02 | 1.17 | 1.28 | 1.34 | 1.43 |

| PULSE COUNT | 0 | 1 | 2 | 3 | 4 | 5 | 6 | 7 |
|---|---|---|---|---|---|---|---|---|
| BLACK → WHITE | 1.48 | 1.14 | 0.77 | 0.58 | 0.47 | 0.42 | 0.39 | 0.36 |

VALUES WHERE THE DENSITY OF CHANGES FROM WHITE-TO-BLACK AND BLACK-TO-WHITE MATCH

| ALL COLOR DENSITY REMOVED | |
|---|---|
| INITIAL DENSITY AT MAXIMUM WHITE LEVEL | 0.35 |
| MAXIMUM BLACK LEVEL → WHITE: 7 PULSES | 0.36 |
| MAXIMUM BLACK LEVEL → WHITE: 6 PULSES | 0.39 |
| MAXIMUM BLACK LEVEL → WHITE: 5 PULSES | 0.42 |
| MAXIMUM BLACK LEVEL → WHITE: 4 PULSES | 0.47 |
| MAXIMUM WHITE LEVEL → BLACK: 1 PULSES | 0.51 |
| MAXIMUM BLACK LEVEL → WHITE: 3 PULSES | 0.58 |
| MAXIMUM BLACK LEVEL → WHITE: 2 PULSES | 0.77 |
| MAXIMUM WHITE LEVEL → BLACK: 2 PULSES | 0.78 |
| MAXIMUM WHITE LEVEL → BLACK: 3 PULSES | 1.02 |
| MAXIMUM BLACK LEVEL → WHITE: 1 PULSE | 1.14 |
| MAXIMUM WHITE LEVEL → BLACK: 4 PULSES | 1.17 |
| MAXIMUM WHITE LEVEL → BLACK: 5 PULSES | 1.28 |
| MAXIMUM WHITE LEVEL → BLACK: 6 PULSES | 1.34 |
| MAXIMUM WHITE LEVEL → BLACK: 7 PULSES | 1.43 |
| INITIAL DENSITY AT MAXIMUM BLACK LEVEL | 1.48 |

VALUES WHERE THE DENSITY OF CHANGES FROM WHITE-TO-BLACK AND BLACK-TO-WHITE MATCH

| PULSE COUNT | 0 | 1 | 2 | 3 | 4 | 5 | 6 | 7 |
|---|---|---|---|---|---|---|---|---|
| WHITE → BLACK | 0.35 | 0.51 | 0.78 | 1.02 | 1.17 | 1.28 | 1.34 | 1.43 |

| PULSE COUNT | 0 | 1 | 2 | 3 | 4 | 5 | 6 | 7 |
|---|---|---|---|---|---|---|---|---|
| BLACK → WHITE | 1.48 | 1.14 | 0.77 | 0.58 | 0.47 | 0.42 | 0.39 | 0.36 |

: VALUES WHERE THE DENSITY OF CHANGES FROM WHITE-TO-BLACK AND BLACK-TO-WHITE MATCH

FIG.12

| ALL COLOR DENSITY REMOVED | |
|---|---|
| INITIAL DENSITY AT MAXIMUM WHITE LEVEL | 0. 35 |
| MAXIMUM BLACK LEVEL → WHITE: 7 PULSES | 0. 36 |
| MAXIMUM BLACK LEVEL → WHITE: 6 PULSES | 0. 39 |
| MAXIMUM BLACK LEVEL → WHITE: 5 PULSES | 0. 42 |
| MAXIMUM BLACK LEVEL → WHITE: 4 PULSES | 0. 47 |
| MAXIMUM WHITE LEVEL → BLACK: 1 PULSES | 0. 51 |
| MAXIMUM BLACK LEVEL → WHITE: 3 PULSES | 0. 58 |
| MAXIMUM BLACK LEVEL → WHITE: 2 PULSES | 0. 77 |
| MAXIMUM WHITE LEVEL → BLACK: 2 PULSES | 0. 78 |
| MAXIMUM WHITE LEVEL → BLACK: 3 PULSES | 1. 02 |
| MAXIMUM BLACK LEVEL → WHITE: 1 PULSE | 1. 14 |
| MAXIMUM WHITE LEVEL → BLACK: 4 PULSES | 1. 17 |
| MAXIMUM WHITE LEVEL → BLACK: 5 PULSES | 1. 28 |
| MAXIMUM WHITE LEVEL → BLACK: 6 PULSES | 1. 34 |
| MAXIMUM WHITE LEVEL → BLACK: 7 PULSES | 1. 43 |
| INITIAL DENSITY AT MAXIMUM BLACK LEVEL | 1. 48 |

VALUES WHERE THE DENSITY OF CHANGES FROM WHITE-TO-BLACK AND BLACK-TO-WHITE MATCH

FIG. 13

| COLOR LEVEL | DENSITY |
|---|---|
| WHITE LEVEL 6 | 0. 35～0. 36 |
| WHITE LEVEL 5 | 0. 39 |
| WHITE LEVEL 4 | 0. 42 |
| WHITE LEVEL 3 | 0. 47 |
| WHITE LEVEL 2 | 0. 51 |
| WHITE LEVEL 1 | 0. 58 |
| BLACK LEVEL 1 | 0. 77～0. 78 |
| BLACK LEVEL 2 | 1. 02 |
| BLACK LEVEL 3 | 1. 14～1. 17 |
| BLACK LEVEL 4 | 1. 28 |
| BLACK LEVEL 5 | 1. 34 |
| BLACK LEVEL 6 | 1. 43～1. 48 |

LEVELS WHERE CHANGES TO BLACK AND TO WHITE MATCH

FIG. 14

| TARGET VALUE / CURRENT VALUE | W_006 | W_005 | W_004 | W_003 | W_002 | W_001 | B_001 | B_002 | B_003 | B_004 | B_005 | B_006 |
|---|---|---|---|---|---|---|---|---|---|---|---|---|
| W_006 (0.36) | | W_002 | W_002 | W_002 | W_002 | W_002 | W_002 | W_002 | W_002 | W_002 | W_002 | W_002 |
| W_005 (0.39) | W_006 | | W_002 | W_002 | W_002 | W_002 | W_002 | W_002 | W_002 | W_002 | W_002 | W_002 |
| W_004 (0.42) | W_005 | W_005 | | W_001 | W_001 | W_001 | W_001 | W_001 | W_001 | W_001 | W_001 | W_001 |
| W_003 (0.47) | W_004 | W_004 | W_004 | | B_001 | B_001 | B_001 | B_001 | B_001 | B_001 | B_001 | B_001 |
| W_002 (0.51) | W_003 | W_003 | W_003 | W_003 | | B_001 | B_001 | B_001 | B_001 | B_001 | B_001 | B_001 |
| W_001 (0.58) | W_003 | W_003 | W_003 | W_003 | W_003 | | B_001 | B_001 | B_001 | B_001 | B_001 | B_001 |
| B_001 (0.77) | W_001 | W_001 | W_001 | W_001 | W_001 | W_001 | | B_002 | B_002 | B_002 | B_002 | B_002 |
| B_002 (1.02) | B_001 | B_001 | B_001 | B_001 | B_001 | B_001 | B_001 | | B_003 | B_003 | B_003 | B_003 |
| B_003 (1.15) | B_001 | B_001 | B_001 | B_001 | B_001 | B_001 | B_001 | B_001 | | B_004 | B_004 | B_004 |
| B_004 (1.28) | B_003 | B_003 | B_003 | B_003 | B_003 | B_003 | B_003 | B_003 | B_003 | | B_005 | B_005 |
| B_005 (1.34) | B_003 | B_003 | B_003 | B_003 | B_003 | B_003 | B_003 | B_003 | B_003 | B_003 | | B_006 |
| B_006 (1.48) | B_003 | B_003 | B_003 | B_003 | B_003 | B_003 | B_003 | B_003 | B_003 | B_003 | B_003 | |

: TARGET VALUE OVERSHOT

: LEVELS THAT CAN BE REACHED WHEN CHANGING TO BLACK AND TO WHITE

FIG.16

DISPLAY DEVICE AND TIMEPIECE

BACKGROUND

1. Technical Field

The present invention relates to a display device having an electrophoretic display panel containing electrophoretic particles, and to a timepiece having the display device.

2. Related Art

Display devices having a display unit for displaying the time and a control means for controlling displaying content on the display unit are known from the literature. An example of such a display device is the display device (electrophoretic display panel) having electrophoretic particles as taught in Japanese Unexamined Patent Appl. Pub. JP-A-S52-70791.

The electrophoretic display panel taught in JP-A-S52-70791 has an electrophoretic dispersion contained between a transparent common electrode and segment electrodes. The electrophoretic display dispersion is black and contains negatively charged color particles and positively charged white particles. When a potential difference is created between the transparent electrode and the segment electrodes, the charged particles of one color migrate to the transparent electrode side, the particles of the other color migrate to the segment electrode side, and the color of the particles that migrated to the transparent electrode side is visible to the viewer. By controlling the voltage applied to the common electrode and the segment electrodes and the time the voltage is applied, the migration of particles to each of the electrodes can be adjusted and the gray level of the displayed color can be adjusted. Text and other information can be displayed by using a plurality of segments containing the electrophoretic dispersion.

A problem with this electrophoretic display panel is that the process for displaying the desired gray level is difficult because it is difficult to achieve a proportional relationship between the number of positive and negative voltage pulses applied to the electrophoretic dispersion and the gray level of the displayed color.

More specifically, the gray level changes on a saturation curve in an electrophoretic display panel so that when one pulse is applied to change from a black display state to white and to change from a white display state to black, the gray level may change abruptly. On the other hand, when one pulse is applied to change from an intermediate gray level to black or to white, the time the one voltage pulse is applied varies according to the current display state (gray level). The number of applied pulses must therefore be controlled to follow the saturation curve of the displayed gray level, and the process required to display the desired gray level becomes complicated.

SUMMARY

The display device and timepiece of the invention afford a simple process for displaying the desired color.

A display device according to a preferred aspect of the invention has an electrophoretic display panel that has two types of electrophoretic elements of different color and polarity disposed between electrodes, and changes display state according to an applied voltage; and a drive means for driving the electrophoretic display panel by applying a voltage between the electrodes. The drive means has a storage means for storing color transition information correlating the color levels displayed by the electrophoretic elements to the color level that is displayed when a positive pulse is applied and the color level that is displayed when a negative pulse is applied to the electrode connected to the electrophoretic elements displaying a particular color level; a target value setting means for setting as a target value the color level to be displayed by the electrophoretic elements; and a pulse applying means for applying a pulse of a specific voltage level to the electrode at least until a current value denoting the current color level of the electrophoretic elements matches the target value. The pulse applying means has a value determination unit for determining if the current value and the target value match; a pulse application unit for applying either a positive pulse or a negative pulse to the electrode so that the current value approaches the target value if the value determination unit determines the current value and the target value do not match; a transition value acquisition unit for getting from the color transition information a transition value denoting the color level after the pulse is applied; and a current value updating unit for updating the current value to the transition value.

When the pulse applying means adjusts the color level of the electrophoretic display panel to the target value set by the target value setting means, the value determination unit of the pulse applying means compares the target value with the current value denoting the current color level of the electrophoretic display panel, and determines if the target value and the current value match. If these values no not match, the pulse application unit applies to the electrode a pulse causing the current value to shift towards the target value.

If the electrophoretic display panel is arranged so that, for example, the color level rises when the pulse application unit applies a positive pulse and the color level drops when a negative pulse is applied, a positive pulse is applied when the current value is lower than the target value, and a negative pulse is applied when the current value is higher than the target value. The pulse application unit applies to the electrode the same number of pulses set in the applied pulse count in the color transition information stored in the storage means. The transition value acquisition unit then references the color transition information to get the transition value, which is the color level that is changed to from the current value when the pulse application unit applies a pulse, and the current value updating unit updates the current value to this transition value. The value determination unit [sic] then determines if the color level of the updated current value and color level of the target value match, and this process repeats until these values match.

Because the color levels to which the color level changes when a positive pulse or a negative pulse is applied are stored as the transition values in the color transition information in the storage means, pulses can be applied until the color level obtained by applying a pulse matches the target value. Because pulses are applied while comparing the updated current value with the target value, the color level can be appropriately shifted from the current value to the target value, and the display color can be driven to the target value using a simpler process than when the number of pulses to be applied is determined before applying any pulses. The desired color display can thus be achieved by means of a simple process.

The appropriate current value can therefore be held even if the target value is changed while the color level is being changed because the current value denoting the current color level is constantly updated to the transition value. The changed target value can therefore be desirably reached without recalculating the required pulse count by continuing to apply pulses while comparing the current value with the newly set target value. The processing time needed to change the color level can thus be shortened. Response can also be improved and power consumption by the display device can be reduced because the processing time can be shortened without requiring a complicated process to change the color level.

The color transition information stored in the storage means can also be easily changed for compatibility with different electrophoretic display panels when the version changes due to a change in the specifications of the electrophoretic display panel or production lot, for example.

More specifically, the relationship between the number of pulses applied (the "applied pulse count"), the voltage level of the pulses, and the color level achieved by applying a pulse may change when the electrophoretic display panel changes. This can further complicate the control process because the process that was used to control applying pulses before the electrophoretic display panel was changed may require correction.

By getting the transition value from color transition information compiled for the specific electrophoretic display panel, however, the present invention can appropriately store and update the current value, and can get the transition value achieved when a pulse is applied as needed. A simple process can therefore be used to desirably drive the display to the target value denoting the desired color level. The utility of the display device is thus also improved because it can be easily adapted to different kinds of electrophoretic display panels.

Preferably, the color transition information is stored in the storage means as a table correlating a plurality of color levels that can be displayed by the electrophoretic display panel, and the transition value that results when either a positive pulse or a negative pulse is applied to the electrode connected to the two types of electrophoretic elements at each of the plural color levels.

By storing the color transition information as a table in the storage means, this aspect of the invention enables managing the color transition information more easily than when individual color transition information is stored, and the transition value denoting the color to which the display changes from the current value when a positive pulse or a negative pulse is applied can be acquired quickly by the transition value acquisition unit. The processing time needed to change the color level can thus be further shortened, and power consumption by the display device can be further reduced.

Further preferably, the color transition information is stored in the storage means as a table having the plurality of color levels set on one axis and the target values and the color levels that can be displayed by the electrophoretic elements set on the other axis; and the transition values are set to the color level that is displayed when either one positive pulse or one negative pulse is applied to the electrode connected to the electrophoretic elements in the display state of the current value.

In this aspect of the invention the color transition information is stored as a table having the plurality of color levels that can be displayed by the electrophoretic display panel and are selected as the current value set on one axis, and the plural color levels that can be set as the target values set on the other axis. As a result, by finding the current color level of the electrophoretic device in the current values set on the one axis of the color transition information, and setting the target value based on the color levels set on the other axis of the table, the direction of the color shift required to reach the target value can be easily determined, and whether a positive or negative pulse should be applied can be easily determined. The appropriate pulse can therefore be applied to the electrode.

Yet further preferably, the transition values of the color transition information denote the color levels that will be displayed when one positive or negative voltage pulse is applied to the electrode of the electrophoretic display panel displaying a color level set in the color transition information. As a result, the transition value denoting the color level that is reached from the current value when the smallest unit of pulses is applied can be determined. A greater number of transition values can thus be achieved, and the color level of the electrophoretic display panel can be controlled in finer increments by applying pulses in units of one pulse at a time to the electrodes.

Further preferably, the target value setting means sets the target value to a color level at which the display state is substantially the same whether the color level is increased and when the color level is decreased.

When a pulse is applied to change the current value toward the target value, the color level reached by the applied pulse will not necessarily be the same when the current value is increased to reach the desired color level and when the current value is decreased to reach the desired color level.

For example, in a monochrome electrophoretic display panel that can display any of seven color levels, applying four pulses to change from level 1 (equal to the whitest display level at the lowest color density, for example) towards level 7, and applying three pulses to change from level 7 (equal to the blackest display level at the highest color density, for example) towards level 1, should produce the same display level 4, but this is not always the case. As a result, it may not be possible to achieve the desired display color depending on whether the color level must be increased or decreased to reach the desired color.

The target value setting means of the invention therefore sets as the target value a color level that is substantially the same whether the color level is increased or decreased to the new color level, and thereby achieves substantially the same display state when changing the color level regardless of the direction in which the color level changes. In addition, even if the target value changes while the color level is changing, the color of the color level corresponding to the target value can be appropriately displayed.

In another aspect of the invention the two types of electrophoretic elements are color particles of different saturation levels; and the color level is a gradation level of saturation that can be expressed by the color particles.

An example of such electrophoretic particles are black particles and white particles.

The invention can thus be used to desirably drive a monochrome display on an electrophoretic display panel and to control the display to accurately display a plurality of intermediate gray levels. A color display can also be achieved by disposing color filters at positions aligned with the electrophoretic particles, and to control the display to accurately display colors at the desired gray levels. The utility of the display device is thus yet further improved.

Another aspect of the invention is a timepiece having the display device of the invention and a case for holding the display device.

This aspect of the invention affords the same benefits as the display device described above.

More specifically, the target value and the updated current value are compared when a pulse is applied, and the color level is changed by applying pulses to the electrophoretic particles (segments) until these values match. The current value and the target value are evaluated each time a pulse is applied, the transition value representing the color displayed after a pulse is applied at the current color level is acquired from the color transition information, and the current value is updated to this transition value. The current value can thus be appropriately stored and updated, and the desired color level can be displayed using a simpler process than when pulses are applied after calculating the number of pulses to be applied.

The invention does not require a complicated computation process to set the number of pulses applied, and can therefore display the desired color using a simple process and can reduce power consumption. The invention also improves the response of the electrophoretic display panel when changing the color level of a displayed image.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 12 shows the color density determined by the number of pulses applied when changing to black and when changing to white in the preferred aspect of the invention.

FIG. 13 shows the color density arranged in ascending order when changing from the whitest display state to black and from the blackest display state to white in the preferred aspect of the invention.

FIG. 14 shows the table in FIG. 13 with matching color densities grouped together.

FIG. 16 shows a lookup table containing the color transition information in the preferred aspect of the invention.

DESCRIPTION OF EXEMPLARY EMBODIMENTS

A preferred embodiment of the present invention is described below with reference to the accompanying figures.

1. Timepiece Arrangement

Figure 1:
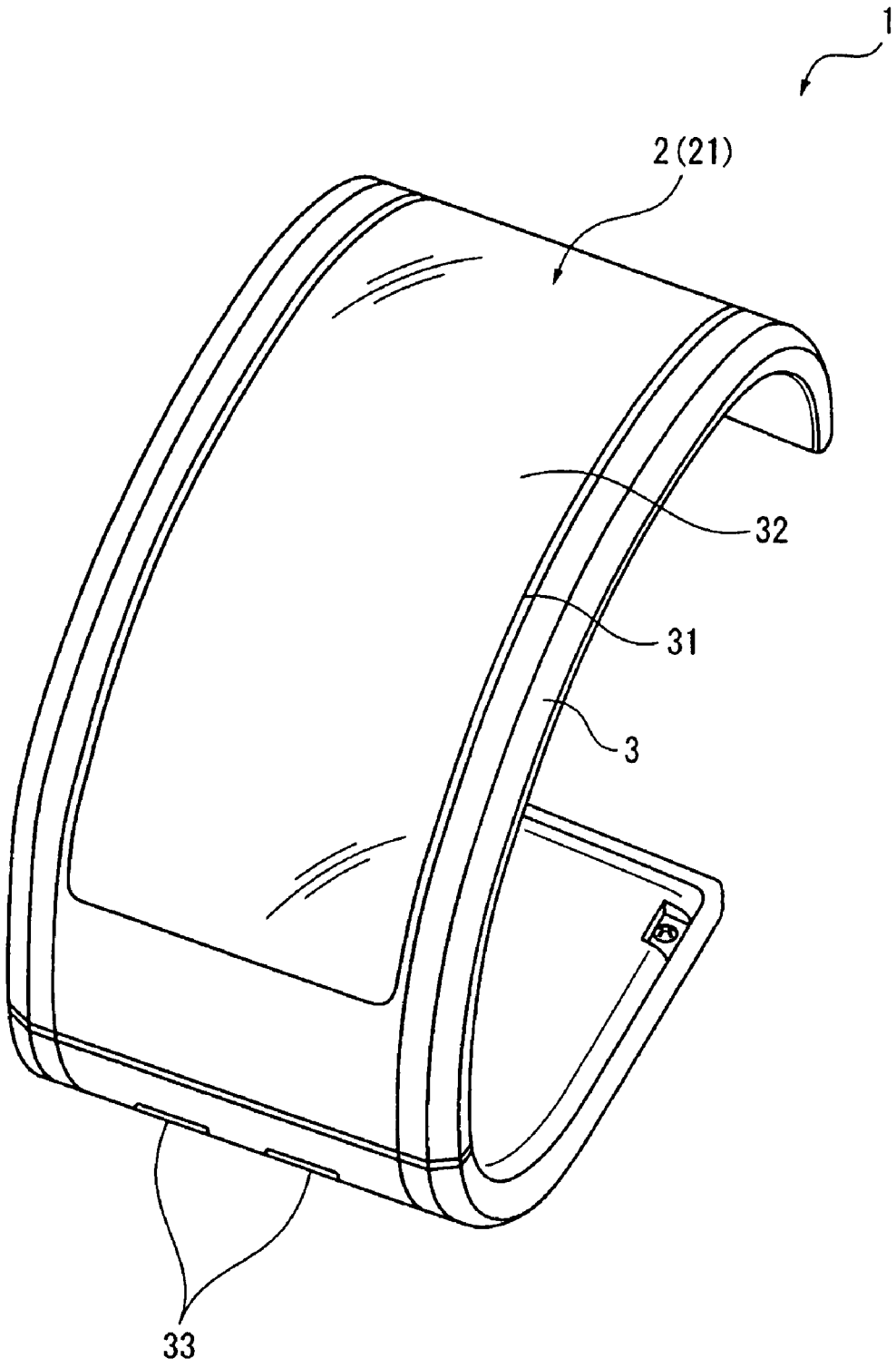
FIG. 1 is an oblique view of a timepiece according to a preferred aspect of the invention.

FIG. 1 is an oblique view of a timepiece 1 according to a preferred embodiment of the invention.

This timepiece 1 is described as a wristwatch that is worn as a bracelet on the user's wrist, for example, and as shown in FIG. 1 has a display device 2 for displaying time and date information, and a case 3 that holds the display device 2 inside.

The case 3 is basically C-shaped when seen from the side to conform to the general shape of the user's wrist. A window 31 in which the display panel 21 of the display device 2 (see FIG. 2) is exposed is formed in the case 3, and a transparent cover 32 that covers the window 31 and protects the display panel 21 is disposed in the window 31. Two buttons 33 are disposed in line with each other in the case 3 so that pressing the buttons 33 depresses a corresponding pressure sensitive means 221 disposed to the control circuit board 22 of the display device 2 (see FIG. 2) and causes the control circuit board 22 to execute a specific process.

2. Display Device Arrangement

Figure 2:
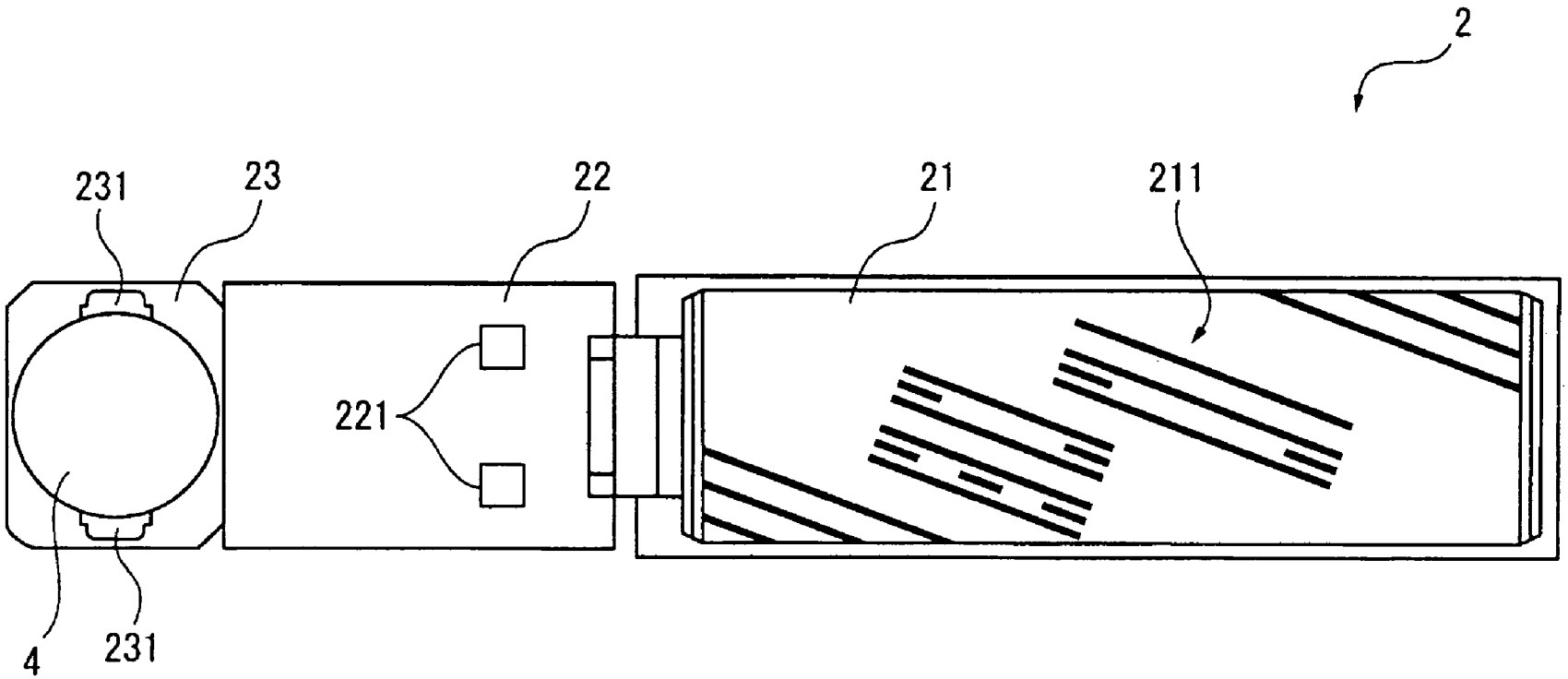
FIG. 2 is a schematic plan view of the display device in the preferred aspect of the invention.

FIG. 2 is a schematic plan view of the display device 2.

As shown in FIG. 2 the display device 2 has a display panel 21 for displaying graphics and text such as the time, a control circuit board 22 for controlling driving the display panel 21, and a battery compartment 23 for holding a battery 4 to supply power to the display panel 21 and the control circuit board 22.

The battery compartment 23 is disposed to the opposite end of the display device 2 as the display panel 21 and has a pair of tabs 231 to hold the battery 4. This aspect of the invention uses a button cell (primary cell) as the battery 4, but a secondary cell can be used instead.

2-1 Display Panel Arrangement

Figure 3:
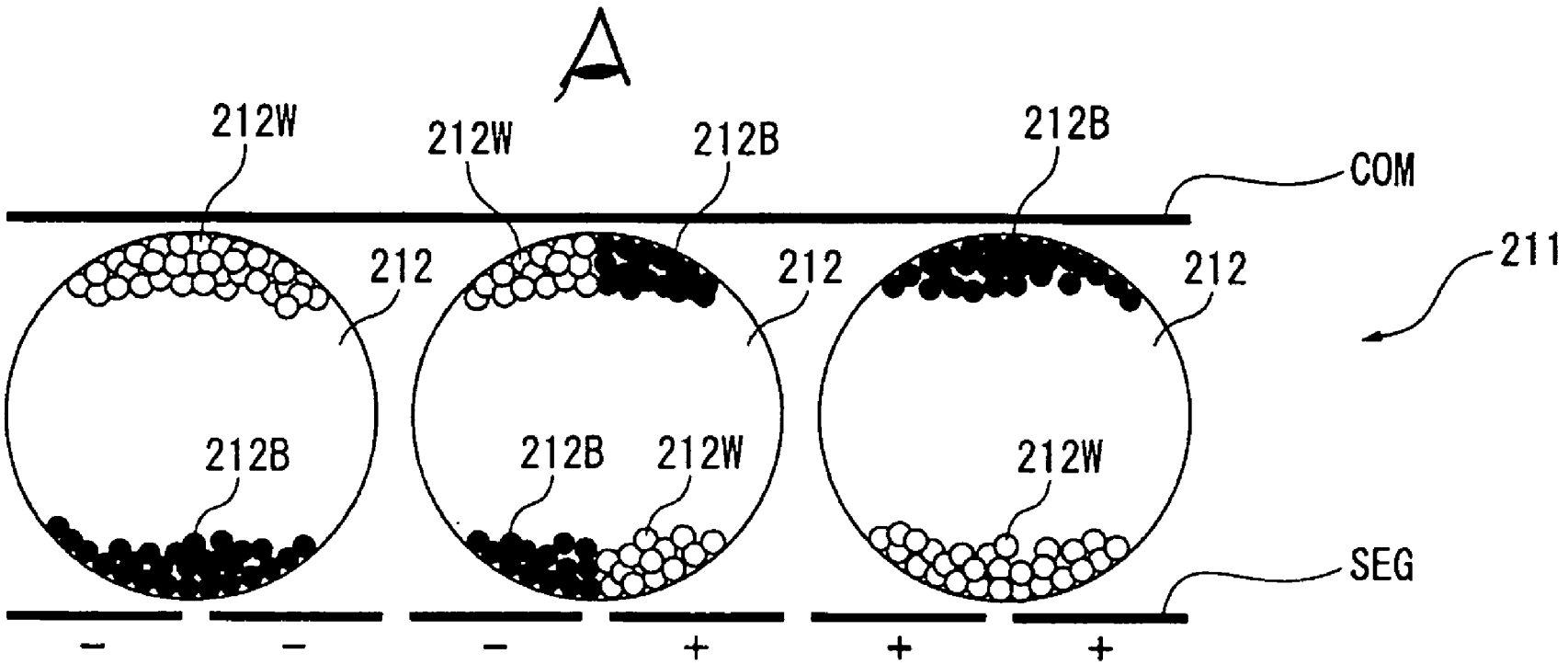
FIG. 3 is a schematic section view of the display panel in the preferred aspect of the invention.

FIG. 3 is a schematic diagram of the display panel 21.

The display panel 21 is an electrophoretic display panel that has white particles 212W and black particles 212B as shown in FIG. 3. The display panel 21 is divided into a plurality of segments 211, and the display state of each segment changes according to the pulses input from the control circuit board 22.

A plurality of segments 211 as shown in FIG. 2 and FIG. 3 are disposed to the display panel 21. Each segment 211 has a common electrode COM rendered from a transparent conductor such as ITO (indium tin oxide) and a segment electrode SEG, and numerous microcapsules 212 disposed between the common electrode COM and the segment electrode SEG.

The common electrode COM and the segment electrode SEG are electrically connected to the control circuit board 22 to apply the voltage (pulse) input from the control circuit board 22 to the microcapsules 212.

As shown in FIG. 3, the white particles 212W, the black particles 212B, and a fluid (not shown in the figure) in which the particles are suspended are sealed inside the microcapsules 212. The white particles 212W are negatively charged and the black particles 212B are positively charged.

As a result, when voltage is applied to the electrodes COM and SEG so that the common electrode COM is positively charged and the segment electrode SEG is negatively charged, the negatively charged white particles 212W migrate to the common electrode COM and the positively charged black particles 212B migrate to the segment electrode SEG as shown in the microcapsules 212 on the left side in FIG. 3.

Conversely, when voltage is applied to the electrodes COM and SEG so that the common electrode COM is negatively charged and the segment electrode SEG is positively charged, the positively charged black particles 212B migrate to the common electrode COM and the negatively charged white particles 212W migrate to the segment electrode SEG as shown in the microcapsules 212 on the right side in FIG. 3.

In both of these display states the particles concentrated on the segment electrode SEG side are obscured by the particles concentrated at the common electrode COM side, and the user therefore sees the color of the particles that are concentrated at the common electrode COM side. If the white particles 212W are concentrated at the common electrode COM, for example, the display appears white (the color density described below is low), and if the black particles 212B are concentrated at the common electrode COM, the display appears black (the color density is high).

2-2 Changing the Segment Display State

Figure 4:
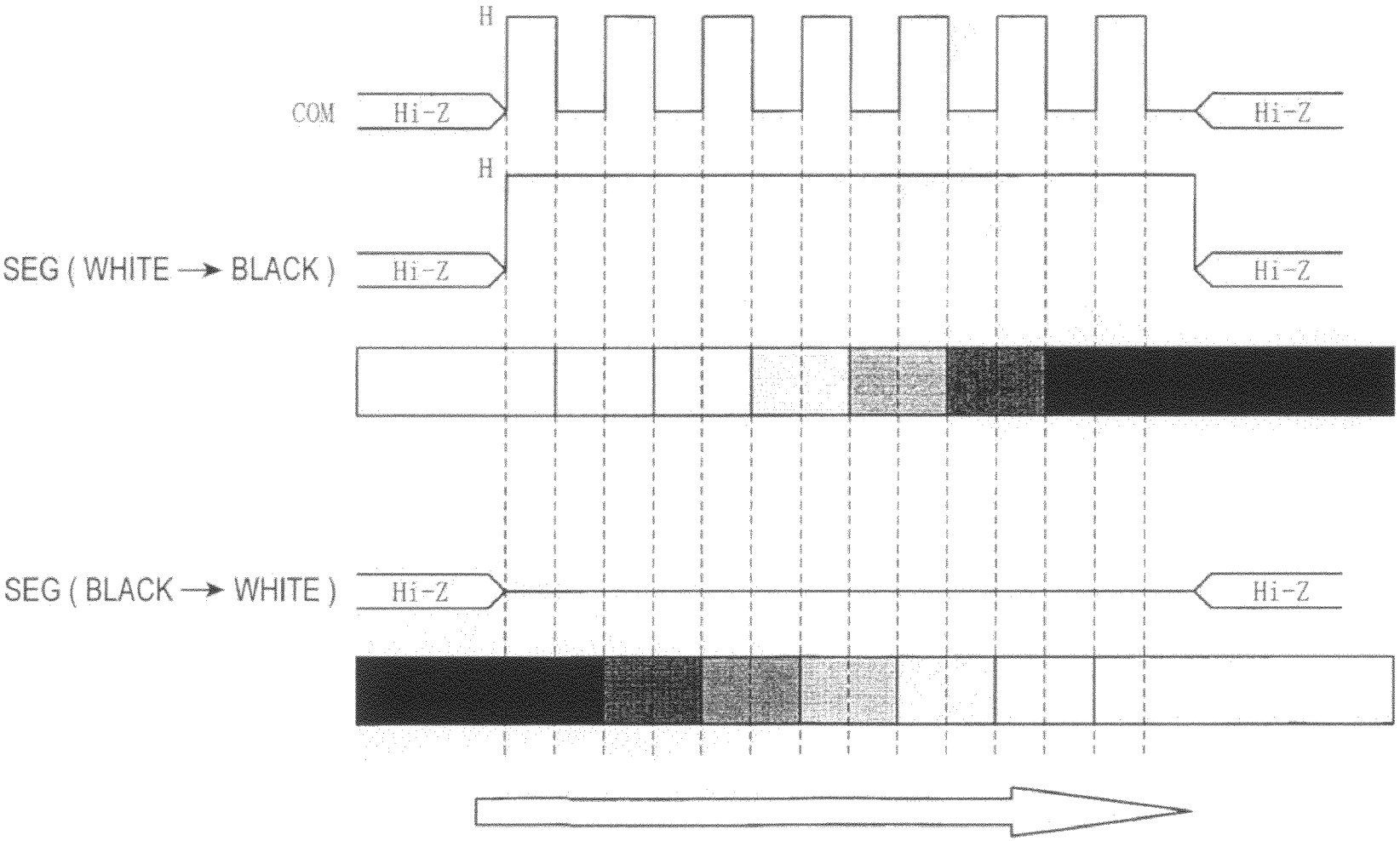
FIG. 4 describes the applied pulse count and the segment display state in the preferred aspect of the invention.

FIG. 4 shows the relationship between the number of applied pulses (the applied pulse count) and the display state of the segment 211 to which the pulses are applied.

As shown in FIG. 4, a high level voltage and a low level voltage are alternately applied four times each in one second to the common electrode COM of a segment 211 containing multiple microcapsules 212. More specifically, the applied voltage switches between a high level and a low level every 125 msec. The pulses applied to the segment electrodes SEG are therefore adjusted in order to produce a positive/negative potential difference between the common electrode COM and the segment electrodes SEG and change the display state of the segment 211. The low level voltage is 0 V and the high level voltage is 15 V in this embodiment of the invention, but these voltage levels can be set desirably within the range of voltages that can be applied to the display panel 21.

More specifically, if 14 consecutive HIGH pulses are applied as shown in the middle row in FIG. 4 to the segment electrode SEG of a segment 211 in the whitest display state (the lowest color density state) while alternately applying HIGH and LOW pulses to the common electrode COM as shown in the top row in FIG. 4, a potential difference is produced between the common electrode COM and the segment electrode SEG every time the pulse applied to the common electrode COM goes LOW. In addition, each time a potential difference is produced some of the black particles 212B migrate toward the common electrode COM and some of the white particles 212W migrate toward the segment electrode SEG. The display state of the segment therefore changes gradually from white to black each time a potential difference is produced. After a HIGH pulse has thus been applied 14 times, producing a potential difference in the black transition direction 7 times, the display state changes from the whitest display state through the intermediate gray levels and reaches the blackest display state (the highest color density display state).

Conversely, if 14 consecutive LOW pulses are applied as shown in the bottom row in FIG. 4 to the segment electrode SEG of a segment 211 in the blackest display state, a potential difference in the opposite direction is produced between the common electrode COM and the segment electrode SEG every time the pulse applied to the common electrode COM goes HIGH. Each time a potential difference is produced some of the white particles 212W migrate toward the common electrode COM and some of the black particles 212B migrate toward the segment electrode SEG. The display state of the segment therefore changes gradually from black to white each time a potential difference is produced. After a HIGH pulse has thus been applied 14 times, producing a potential difference in the white transition direction 7 times, the display state changes from the blackest display state through the intermediate gray levels and reaches the whitest display state.

Figure 5:
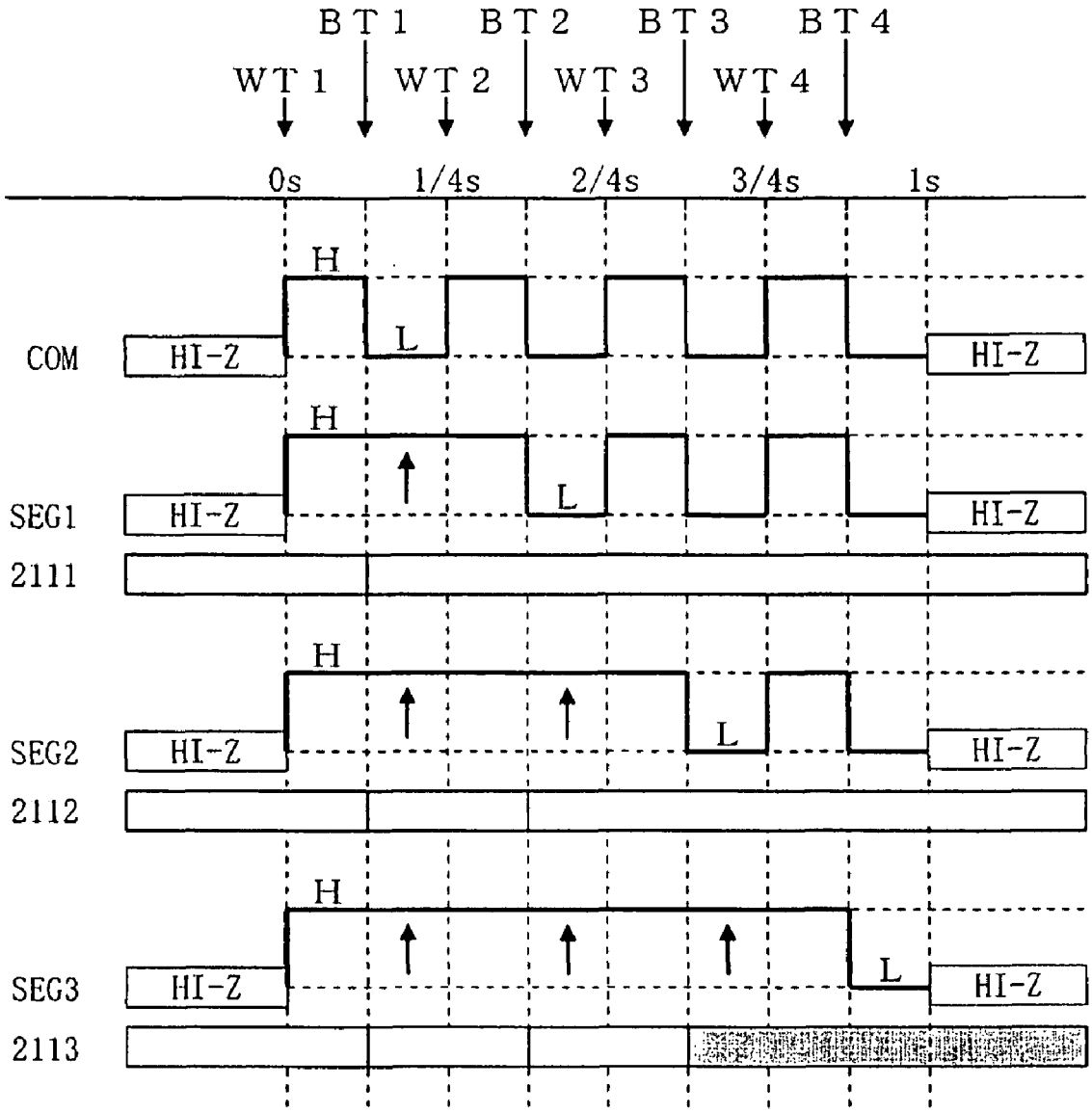
FIG. 5 describes the change in the segment display state when pulses are applied in the preferred aspect of the invention.
Figure 6:
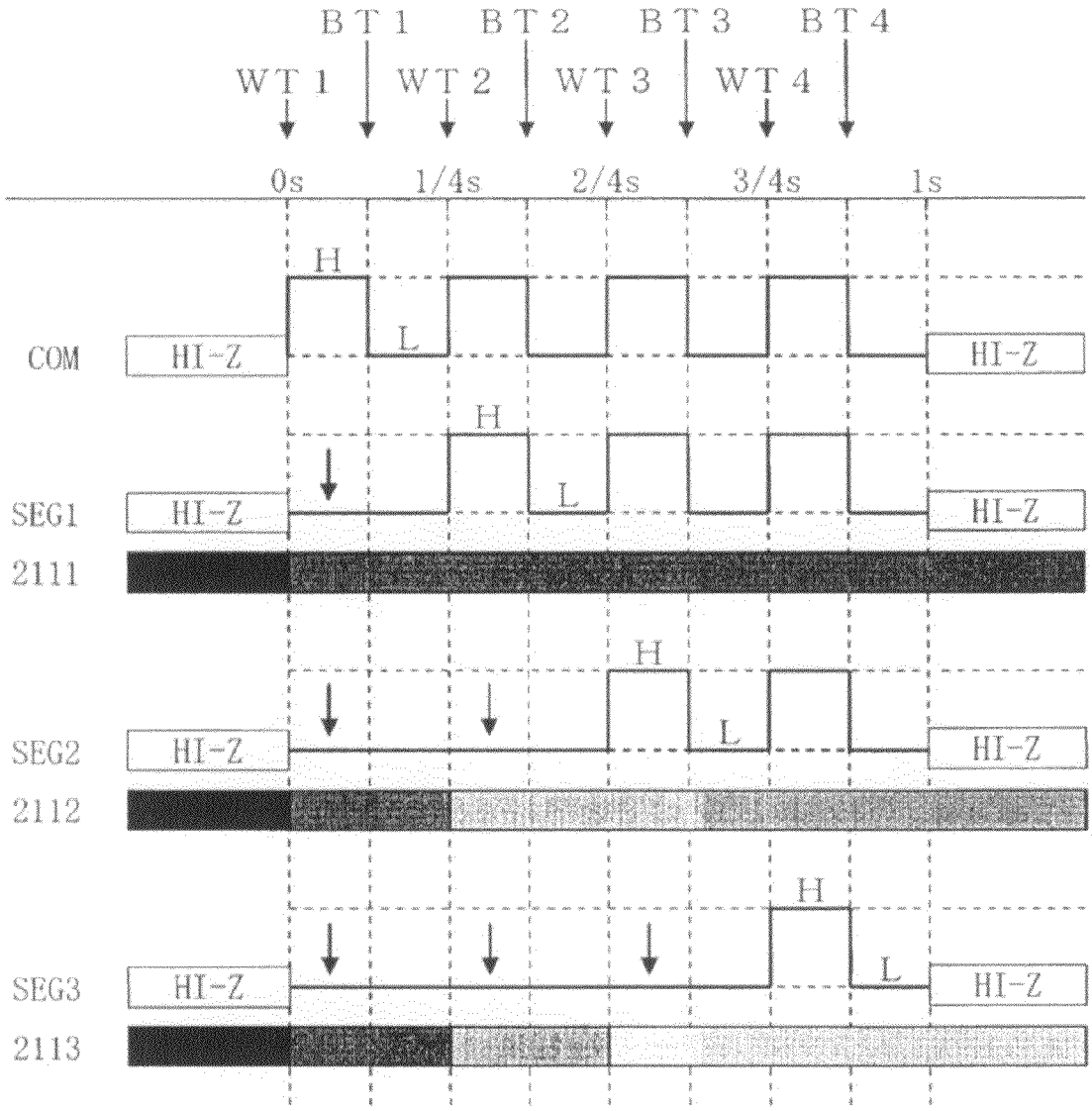
FIG. 6 describes the change in the segment display state when pulses are applied in the preferred aspect of the invention.

FIG. 5 and FIG. 6 show the change in the display state of the segment 211 each time a pulse is applied to the segment electrode SEG. FIG. 5 shows the transition from the whitest display state and FIG. 6 shows the transition from the blackest display state. In FIG. 5 and FIG. 6 BT denotes the black write timing (the timing at which a pulse effecting a change towards a black display state is applied), WT denotes the white write timing (the timing at which a pulse effecting a change towards a white display state is applied), and the indices denote the order.

The gray level of the color displayed by the segments 211 containing the microcapsules 212 thus changes according to the number of times a potential difference is produced between the common electrode COM and the segment electrode SEG. HIGH and LOW level pulses are alternately output four times each in one second to the common electrode COM. As a result, the gradation level of the segment 211 can be changed between black and white by inverting the pulses applied to the segment electrode SEG relative to the pulses applied to the common electrode COM to produce a potential difference between the segment electrode SEG and the common electrode COM.

While four HIGH and LOW pulses each are applied in one second to the common electrode COM in this embodiment of the invention, the number of pulses applied to the common electrode COM and the segment electrode SEG can be changed as needed according to the characteristics of the display panel 21 that is used in the timepiece 1.

More specifically, referring to FIG. 5, if a HIGH pulse is applied to the segment electrodes SEG1, SEG2, SEG3 for the three segments 2111 (top row in FIG. 5), 2112 (middle row in FIG. 5), and 2113 (bottom row in FIG. 5) in the whitest display state when the LOW pulse is applied to the common electrode COM at BT1, a potential difference is produced between the common electrode COM and the segment electrodes SEG. As a result, the display state of each segment 2111, 2112, 2113 changes slightly towards black.

If a HIGH pulse is again applied to the segment electrodes SEG2, SEG3 for the segments 2112 and 2113 when the next LOW pulse is applied to the common electrode COM at BT2, a potential difference is again produced and the display state of segments 2112, 2113 changes further towards black.

If a HIGH pulse is then again applied to the segment electrode SEG3 for the segment 2113 when the next LOW pulse is applied to the common electrode COM at BT3, the display state of segment 2113 changes further towards black.

If the same pulse level applied to the common electrode COM is thereafter applied to the segment electrode SEG (SEG1, SEG2, SEG3) of each segment 2111 to 2113, the display state of each segment 2111 to 2113 can be held.

Note that the timing at which pulses are applied to shift each segment 2111 to 2113 towards black can be set to any of the timing points BT1 to BT4 in one second.

More specifically, referring to FIG. 6, if a LOW pulse is applied to the segment electrodes SEG1, SEG2, SEG3 for the three segments 2111 (top row in FIG. 6), 2112 (middle row in FIG. 6), and 2113 (bottom row in FIG. 6) in the blackest display state when the HIGH pulse is applied to the common electrode COM at WT1, a potential difference in the opposite direction as described in FIG. 5 is produced between the common electrode COM and the segment electrodes SEG. As a result, the display state of each segment 2111, 2112, 2113 changes slightly towards white.

If a LOW pulse is again applied to the segment electrodes SEG2, SEG3 for the segments 2112 and 2113 when the next LOW pulse is applied to the common electrode COM at WT2, a potential difference is again produced and the display state of segments 2112, 2113 changes further towards white.

If a LOW [HIGH, sic] pulse is then again applied to the segment electrode SEG3 for the segment 2113 when the next HIGH pulse is applied to the common electrode COM at WT3, the display state of segment 2113 changes further towards white.

If the same pulse level applied to the common electrode COM is thereafter applied to the segment electrode SEG (SEG1, SEG2, SEG3) of each segment 2111 to 2113, the display state of each segment 2111 to 2113 can be held.

Note that the timing at which pulses are applied to shift each segment 2111 to 2113 towards white can be set to any of the timing points WT1 to WT4 in one second.

2-3 Relationship Between Segment Display State and pulse Application Time

Figure 7:
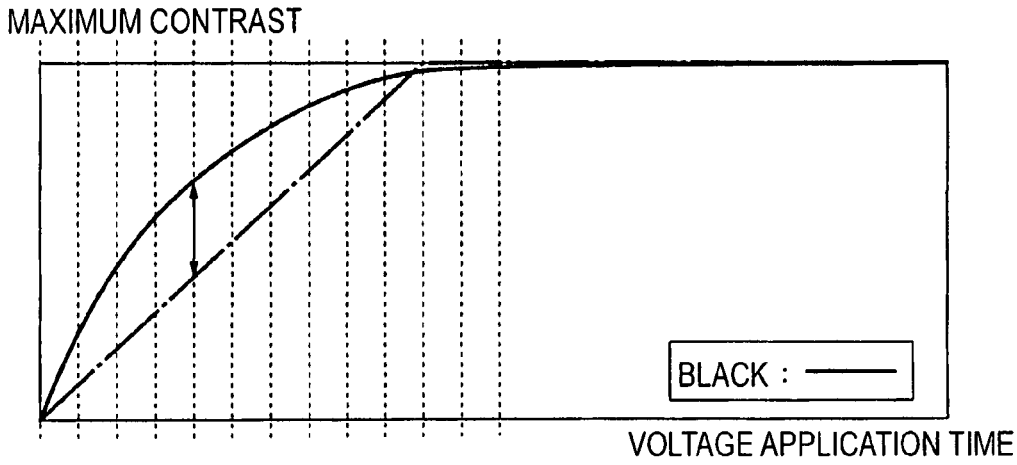
FIG. 7 describes the relationship between the voltage apply time and the change in segment color in the preferred aspect of the invention.
Figure 8:
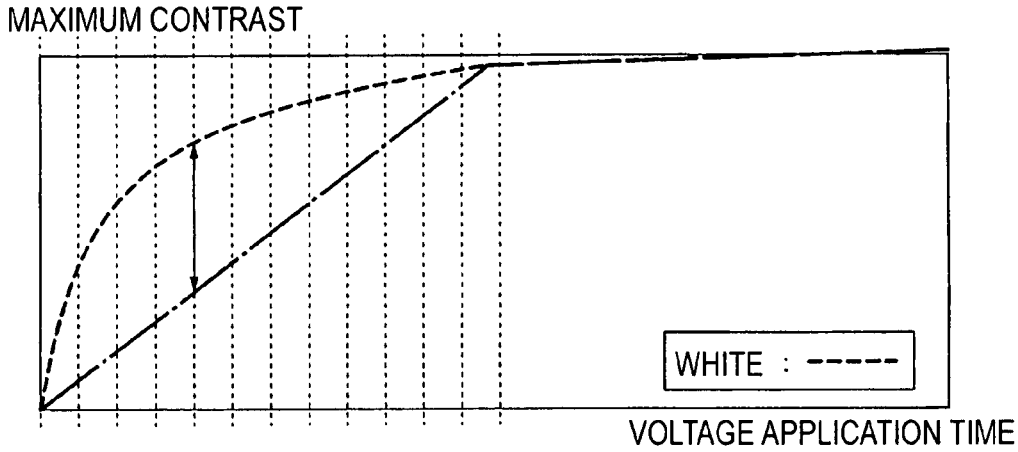
FIG. 8 describes the relationship between the voltage apply time and the change in segment color in the preferred aspect of the invention.

FIG. 7 and FIG. 8 show the relationship between the time the voltage is applied and the color change of the segment 211. More specifically, FIG. 7 shows the change in contrast towards black, and FIG. 8 shows the change in contrast towards white.

The relationship between the time a pulse (voltage) is applied to a segment 211 in the whitest display state and the change in color of the segment 211 is described next.

When a pulse is applied to a segment 211 in the whitest display state to change the display color towards black, the display state of the segment 211 changes toward black as described above. The pulse apply time and the change in contrast are not directly proportional, and the contrast changes according to the applied voltage along a saturation curve as indicated by the solid line in FIG. 7.

When a pulse is applied to a segment 211 in the blackest display state to change the display color towards white, the display state of the segment 211 changes toward white as described above. As when changing the displayed color towards white, the pulse apply time and the change in contrast are not directly proportional, and the contrast changes according to the applied voltage along a saturation curve as indicated by the dotted line in FIG. 8.

The applied pulse count must therefore be controlled according to these curves in order to drive the segment 211 to display the desired color (color density).

Figure 9:
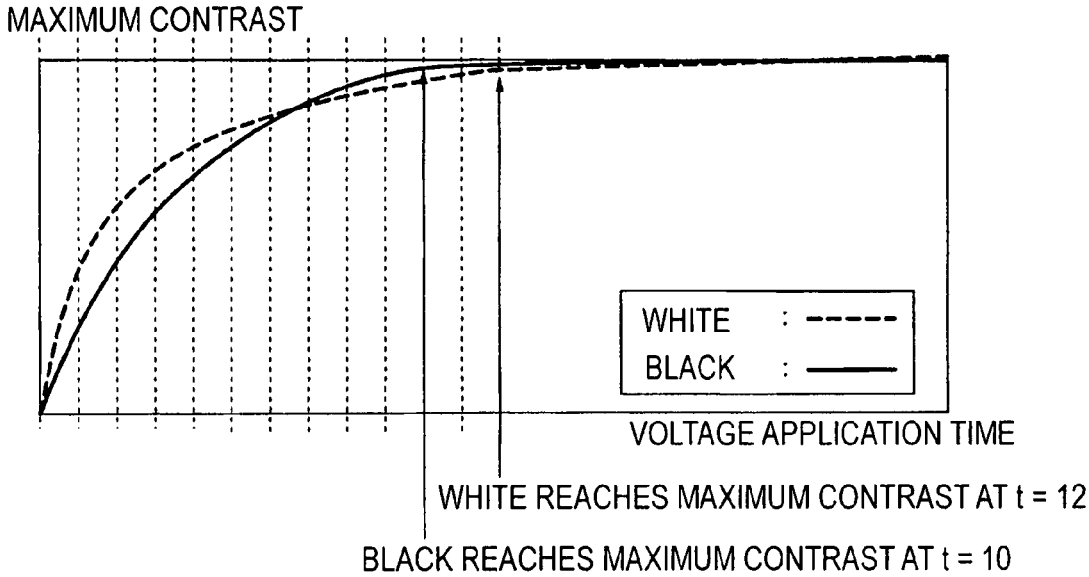
FIG. 9 combines the color change curve in FIG. 7 and the color change curve in FIG. 8.

FIG. 9 superimposes the color change curve to black denoted by the solid line in FIG. 7 with the color change curve to white denoted by the dotted line in FIG. 8.

As will be known from FIG. 9, the voltage that must be applied to change from the whitest display state to the blackest display state and the voltage that must be applied to change from the blackest display state to the whitest display state differ.

More specifically, the pulse application time t required to change from the whitest display state to the blackest display state is t=10, but the pulse application time required to change from the blackest display state to the whitest display state is t=12.

Furthermore, because the color change curve to black and the color change curve to white are not the same, the same color may not result when the same number of pulses is applied to change the current display state of the segment 211 towards black direction and towards white.

As a result, in order to change the display state of the segment 211 to a desired color, the current display state of the segment 211 must first be determined in order to determine the number of pulses that must be applied to change from the current display state to the desired color (black or white).

2-4. Gray Levels That Can be Displayed by the Segment 211

Figure 10:
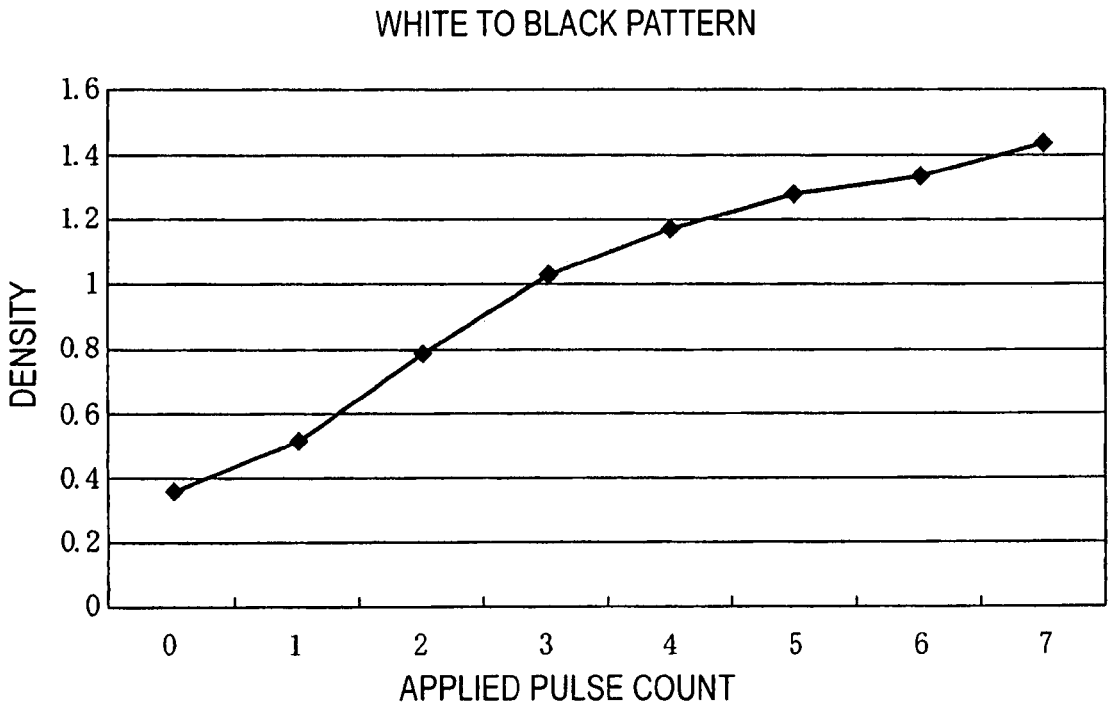
FIG. 10 describes the change in color density according to the number of pulses applied to a segment in the preferred aspect of the invention.
Figure 11:
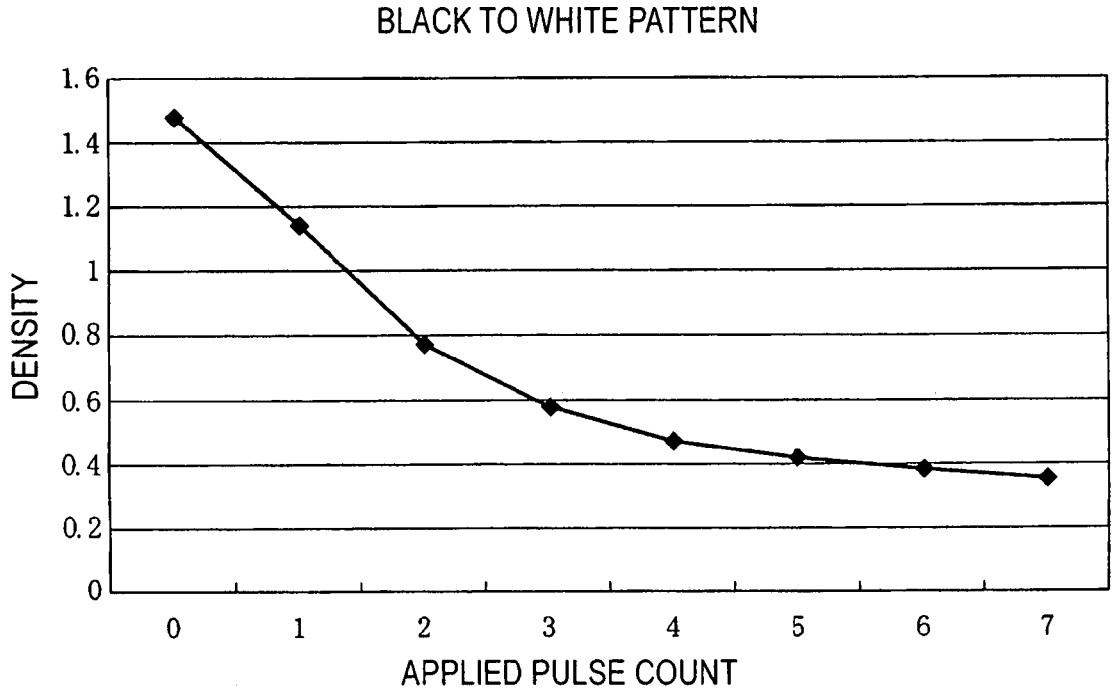
FIG. 11 describes the change in color density according to the number of pulses applied to a segment in the preferred aspect of the invention.

FIG. 10 and FIG. 11 show the change in color density according to the number of pulses applied to a segment 211 of the display panel 21 in this aspect of the invention. FIG. 10 shows the color density when changing to black, and FIG. 11 shows the color density when changing to white. FIG. 12 is a table showing the color density resulting from applying specific pulse counts to change to black and to white. In FIG. 10 to FIG. 12 lower numeric values denote a higher white density and higher numeric values denote a higher black density.

The color of the segment 211 thus changes along a curve to black and to white.

More specifically, when a pulse is applied from 1 to 7 times to change from the whitest display state (average color density=0.35) to black and the average color density of the segment 211 is measured each time a pulse is applied, the color density changes to 0.51, 0.78, 1.02, 1.17, 1.28, 1.34, and 1.43 as shown in FIG. 10 and FIG. 12.

When a pulse is applied from 1 to 7 times to change from the blackest display state (average color density=1.48) to white and the average color density of the segment 211 is measured each time a pulse is applied, the color density changes to 1.14, 0.77, 0.58, 0.47, 0.42, 0.39, and 0.36 as shown in FIG. 11 and FIG. 12.

Note that the values used below as the color density refer to these average color density values.

FIG. 13 shows the change in color density when pulses are applied to change from the whitest display state (where the color density at the maximum white level is 0.35) to black and from the blackest display state (where the color density at the maximum black level is. 1.48) to white as shown in FIG. 10 to FIG. 12 arranged by color density level. FIG. 14 groups the substantially same color density levels in FIG. 13 together.

As shown in FIG. 13, the color density that can be displayed by applying 1 to 7 pulses to change from the whitest display state to black and from the blackest display state to white ranges in 8 levels each from 0.35 to 1.48 for a total 16 gradations, but there are multiple points where the color density is substantially the same when changing from the maximum white level to black and from the maximum black level to white.

More specifically, the maximum white level (color density of 0.35) when changing from the whitest display state to black and the maximum white level (color density of 0.36) achieved when 7 pulses are applied to change from the blackest display state to white are substantially the same color density.

Furthermore, the color density (0.78) achieved when 2 pulses are applied to change from the maximum white level to black, and the color density (0.77) achieved when 2 pulses are applied to change from the maximum black level to white, are substantially equal.

Furthermore, the color density (1.17) achieved when 4 pulses are applied to change from the maximum white level to black, and the color density (1.14) achieved when 4 pulses are applied to change from the maximum black level to white, are substantially equal.

Yet further, the color density (1.43) achieved when 7 pulses are applied to change from the maximum white level to black, and the color density (1.48) achieved when 7 pulses are applied to change from the maximum black level to white, are substantially equal.

When these states where the color density is substantially the same when the display color is changed to black and to white are combined, there are 12 color density levels as shown in FIG. 14 and these 12 levels are the displayable gray levels.

These 12 gray levels can be grouped into white levels and black levels. More specifically, color density level 0.35-0.36 is set as white level 6 (maximum white level), and color density levels 0.39, 0.42, 0.47, 0.51 and 0.58 are set as white levels 5-1, respectively. In addition, color density levels 1.43-

1.48 are set as black level 6, and color density levels 1.34, 1.28, 1.14-1.17, 1.02 and 0.77-0.78 are set as black levels 5-1, respectively.

Of these color levels, white levels 5-1 and black levels 5-1 are intermediate gray levels.

The gray levels of the color density levels that are substantially equal when pulses are applied to change toward black and toward white (that is, white level 6, black level 1, black level 3, and black level 6) are set as the target levels by the target value setting means 223 of the control circuit board 22 described below.

3. Control Circuit Board Arrangement

Figure 15:
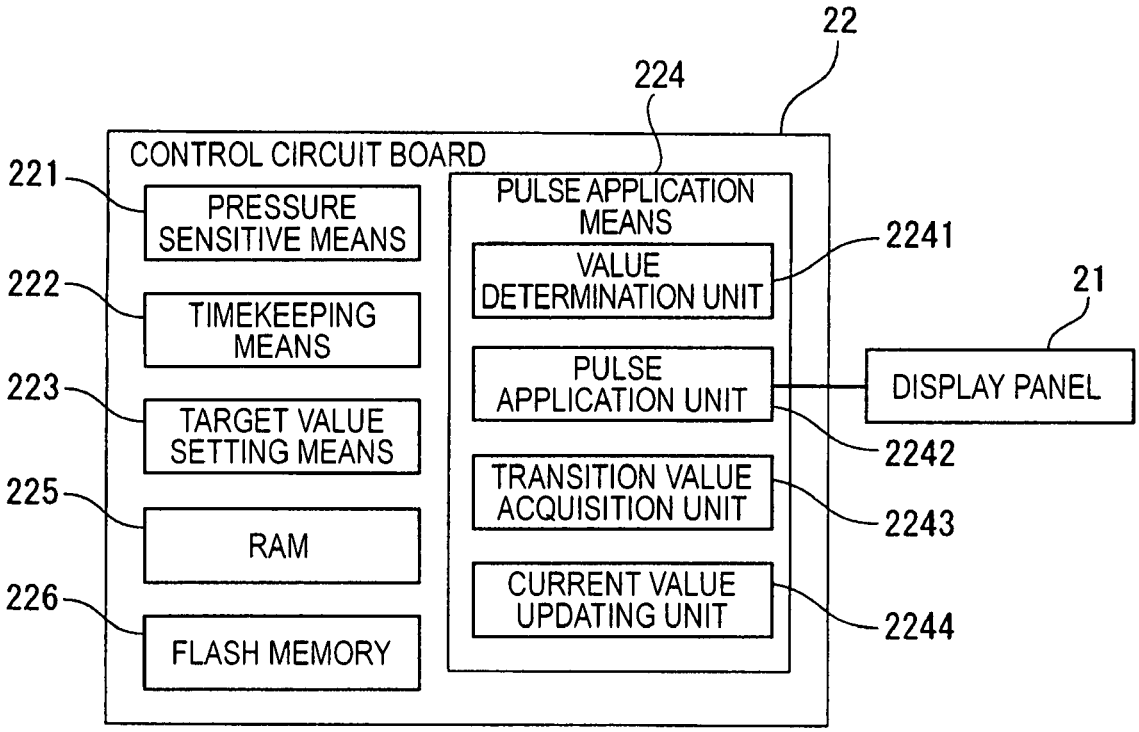
FIG. 15 is a block diagram showing the arrangement of the control circuit board in the preferred aspect of the invention.

FIG. 15 is a block diagram of the control circuit board 22.

The control circuit board 22 is equivalent to the drive means of the accompanying claims, and is rendered as a circuit board for controlling the timepiece 1 as described above. The control circuit board 22 gets power supplied from a battery 4 installed in the battery compartment 23, and applies pulses to the display panel 21 to control the display operation of the display panel 21.

As shown in FIG. 15 the control circuit board 22 has a pressure sensitive means 221, a timekeeping means 222, a target value setting means 223, a pulse application means 224, RAM 225, and flash memory 226.

The RAM 225 is used as working memory, and temporarily stores information including data and programs used by the control circuit board 22 to control operation. This information includes the current gray level (current value) of each segment 211 of the display panel 21, and the target value that is set when changing the display color of the segment 211.

The flash memory 226 is equivalent to the storage means of the accompanying claims, and stores data and programs for controlling driving the timepiece 1, and a lookup table LUT containing the color transition information that is used in the process for changing the display color (referred to herein the "color changing process" below) described below. This lookup table LUT is read by the transition value acquisition unit 2243 of the pulse application means 224 described below, and contains the gray level that results when one pulse is applied to change toward black or toward white.

FIG. 16 shows an example of the lookup table LUT stored in the flash memory 226. In FIG. 16 W denotes a white level and B denotes a black level, and the three-digit index following the W or B denotes the level. Cells in the table containing forward slashes denote the gray levels that can be set along the x-axis, and cells in the table containing backslashes denote gray levels exceeding the target value that will be reached if a pulse is applied from the current level.

More specifically, the lookup table LUT has the gray levels that can be displayed by the segment 211 set on both the y-axis and the x-axis as shown in FIG. 16. The lookup table LUT also shows the gray level that will be displayed when one pulse is applied to change from the current gray level displayed by the segment 211 in the display panel 21 to black or to white. The lookup table LUT is read by selecting the current gray level of the segment 211 from the gray levels listed along the y-axis and then selecting the target value from the gray levels listed along the x-axis. The value in the cell at the intersection of these y-axis and x-axis values is the gray level that will be displayed after one pulse is applied to change the segment 211 from the currently displayed gray level to the target value.

For example, if the current gray level (current value) of the segment 211 is white level 1 (W_001) and one pulse is applied to change to black, the segment 211 will display black level 1 (B_001) after the pulse is applied. If the segment 211 is currently displaying black level 3 (B_003) and one pulse is applied to change toward white, the segment 211 will change to black level 1 (B_001).

As noted above, the cells marked with backslashes in FIG. 16 denote a gray level that overshoots the target value selected on the x-axis when a pulse is applied to change a segment 211 from the current gray level toward black or toward white.

For example, if the current value of the segment 211 is white level 3 (W_003) and one pulse is applied to change the color towards black, the segment 211 will change to black level 1 (B_001) even though the target value is white level 2 (W_002).

Likewise, if the current value of the segment 211 is black level 3 (B_003) and a pulse is applied to change towards white, the segment 211 will change to black level 1 even though the target value is black level 2.

As a result, the target value setting means 223 described below sets as the target value one of the levels that can be reached whether a pulse is applied to change to black or to white, that is, white level 6 (W_006), black level 1 (B_001), black level 3 (B_003), or black level 6 (B_006). This is to avoid complicating the process controlling applying pulses, such as requiring applying both a pulse to black and a pulse to white to the same segment 211 in one second.

Referring again to FIG. 15, the pressure sensitive means 221 detects input from the buttons 33 when either of the buttons 33 on the case 3 is pressed. When input from a button 33 is detected, the pressure sensitive means 221 outputs a control signal to the target value setting means 223. For example, if the pressure sensitive means 221 detects input from one of the two buttons 33, it outputs a control signal to switch the operating mode from the current time mode to the time adjustment mode, and if the pressure sensitive means 221 detects input from the other button 33 it outputs a control signal to display the date and weekday.

The timekeeping means 222 is a timer for keeping the current time.

The target value setting means 223 sets the target value for the gray level to be displayed in each of the segments 211 in order to rewrite the display panel 21 to display content based on the current time kept by the timekeeping means 222 or control signals input form the pressure sensitive means 221.

More specifically, the target value setting means 223 sets the target value for each segment 211 of the display panel 21 and stores the set target values to RAM 225. As described above, the target value setting means 223 sets the target value for any one segment 211 to white level 6, black level 1, black level 3, or black level 6.

The pulse application means 224 references the lookup table LUT stored in flash memory 226, and repeatedly applies a pulse to the segment electrode SEG of the segment 211 to change the segment 211 toward black or toward white until the current value and the target value for each segment 211 stored in RAM 225 match. The pulse application means 224 applies pulses separately for each segment 211.

The pulse application means 224 includes a value determination unit 2241, a pulse application unit 2242, a transition value acquisition unit 2243, and a current value updating unit 2244.

The value determination unit 2241 compares the current value of the segment 211 with the target value of the segment 211 set by the target value setting means 223, and determines if these values match. If the values are not the same, the pulse application unit 2242 applies a pulse to the segment electrode SEG of the segment 211 to change the segment 211 one step further toward black or toward white.

Based on the current value of the segment 211 to which pulses are applied, the pulse application unit 2242 determines whether to apply a pulse toward black or toward white. More specifically, the pulse application unit 2242 compares the current value of the segment 211 stored in RAM 225 and the target value of the same segment 211 stored in RAM 225, and determines whether the change from the current value to the target value is toward black or toward white. More specifically, if the current value is to the left of the target value on the x-axis in the lookup table LUT (shown in FIG. 16), the pulse is applied to effect a change to black, and if on the right side the pulse is applied to effect a change to white.

If the pulse application unit 2242 determines the change is to black, one pulse to black is applied to the segment electrode SEG connected to the segment 211, and if the change is to white, one pulse to white is applied. For example, if the current value of the segment 211 is black level 1 (B_001) and the target value is black level 6 (B_006), one pulse to black is applied, but if the target value is white level 6 (W_006), one pulse to white is applied.

The transition value acquisition unit 2243 references the color transition information stored in the flash memory 226 to get the gray level displayed after a pulse is applied by the pulse application unit 2242.

More specifically, the transition value acquisition unit 2243 selects the value corresponding to the current value of the gray level displayed by the segment 211 before a pulse is applied by the pulse application unit 2242 (that is, the current value of the segment 211 stored in RAM 225) from the current values on the y-axis of the color transition information in the lookup table LUT. For example, if the current value of the segment 211 before a pulse is applied is black level 1 (B_001), the transition value acquisition unit 2243 selects black level 1 (B_001) from the current values on the y-axis of the color transition information in the lookup table LUT.

The transition value acquisition unit 2243 then selects the target value from the gray levels on the x-axis of the color transition information. If black level 6 is set as the target value, for example, the transition value acquisition unit 2243 selects black level 6 (B_006) from the gray levels on the x-axis of the color transition information.

The transition value acquisition unit 2243 then finds the value of the cell at the intersection of black level 1 (B_001) selected from the gray levels on the y-axis and black level 6 (B_006) selected from the gray levels on the x-axis. In the previous example, the transition value acquisition unit 2243 thus gets black level 2 (B_002) This value denotes the gray level that will be changed to from the current value when a pulse is applied by the pulse application unit 2242. When the transition from the current value to the target value is to white, the gray level of the target is determined in the same way.

The current value updating unit 2244 then updates the current value of the segment 211 stored in RAM 225 to the transition value retrieved by the transition value acquisition unit 2243.

4. Color Changing Process

The color changing process that is executed by the control circuit board 22 to change the color displayed by a segment 211 of the display panel 21 is described next.

Figure 17:
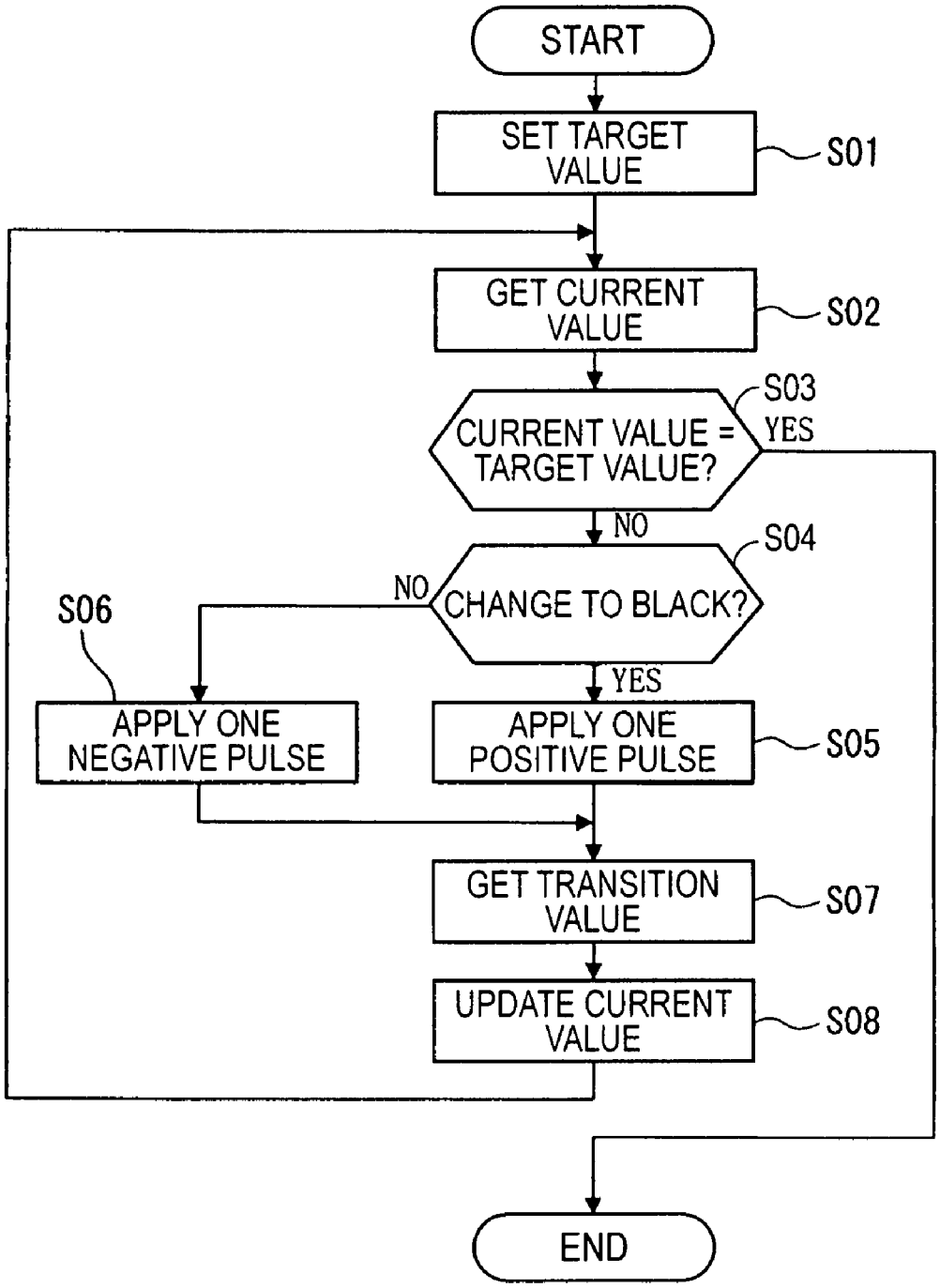
FIG. 17 is a flow chart of the process run to change the display color in the preferred aspect of the invention.

FIG. 17 is a flow chart of the color changing process.

The color changing process is run for each segment 211 when the display panel 21 must be rewritten to display new content, such as when the current time is being displayed and the time changes or when one of the buttons 33 is pressed to change the display mode.

More specifically, when the color changing process starts, the target value setting means 223 of the control circuit board 22 first sets the gray level to be displayed by a particular segment 211 (the target segment 211) of the display panel 21 based on the content to be displayed as the target value for the segment 211, and temporarily stores this target value for the target segment 211 in RAM 225 (step S01).

After step S01, the value determination unit 2241 of the pulse application means 224 gets the current gray level (the current value) of the target segment 211 from RAM 225 (step S02), and compares the current value with the target value stored to RAM 225 (step S03).

If the value determination unit 2241 determines that the current value and the target value of the target segment 211 are the same, the value determination unit 2241 determines that changing the display content is not necessary, that is, that applying a pulse to change the display color is not necessary, and the color changing process ends.

If the value determination unit 2241 determines that the current value and the target value of the target segment 211 are not the same, the pulse application unit 2242 determines whether the pulse is to be applied to change to black or to white (step S04), and based on the result applies one pulse either to black or to white to the segment electrode SEG of the target segment 211.

More specifically, the pulse application unit 2242 compares the target value and the current value, and applies one positive pulse (that is, a pulse to black) if the color density of the target value is greater than the color density of the current value (that is, if the current value is to the left of the target value on the x-axis of the lookup table LUT) (step S05).

However, if the color density of the target value is less than the color density of the current value (that is, if the current value is to the right of the target value on the x-axis of the lookup table LUT), the pulse application unit 2242 applies one negative pulse (that is, a pulse to white) (step S06).

The pulse applied by the pulse application unit 2242 causes the color density of the target segment 211 to approach the color density of the target value.

When the pulse application unit 2242 applies a pulse, the transition value acquisition unit 2243 gets the gray level of the target segment 211 resulting from applying the pulse from the lookup table LUT stored in flash memory 226 (step S07).

The current value updating unit 2244 then updates the current value of the target segment 211 stored in RAM 225 to the transition value acquired by the transition value acquisition unit 2243 in step S07 (step S08).

Step S02 repeats after step S08, and the value determination unit 2241 of the pulse application means 224 again gets the current value of the target segment 211 that is being changed from RAM 225. The value determination unit 2241 then compares the current value with the target value and ends the color changing process if the values match as described above. If the values do not match, steps S04 to S08 repeat. Steps S02 to S08 thus repeat until the current value and the target value of every segment 211 match.

This color changing process is described more specifically below using a target value of black level 3 and an initial current value of black level 1.

To change the display state of a segment 211 having a current value of black level 1 to black level 3, the target value setting means 223 first sets the target value of the target segment 211 to black level 3 in the color changing process (step S01). The value determination unit 2241 of the pulse application means 224 then gets the current value (black level 1) of the target segment 211 and the target value (black level 3) of the target segment 211 from RAM 225. The value determination unit 2241 then compares the current value and the target value (step S03) and determines the values are not the same. As a result, the pulse application unit 2242 then determines whether the direction that the current value must shift in order to reach the target value is to black or to white (step S04).

In this example the color density of the current value, black level 1, is 0.77, and the color density of the target value, black level 3, is 1.15. The pulse application unit 2242 therefore determines that a pulse to black must be applied to the target segment 211, and the pulse application unit 2242 applies one pulse to black to the segment electrode SEG of the target segment 211 (step S05). The transition value acquisition unit 2243 also reads the lookup table LUT to find the gray level that results from applying one pulse to black when the current value is black level 1 and the target value is case 3 (step S07). The transition value acquired from the lookup table LUT in this case is black level 2, and the current value updating unit 2244 therefore updates the current value (black level 1) of the segment 211 that is stored in RAM 225 to the transition value (black level 2).

The value determination unit 2241 again acquires the current value (black level 2) of the segment 211 from RAM 225, compares the current value and the target value (step S03), and steps S04 to S08 repeat. When the pulse application unit 2242 applies one pulse to black this time, the display state of the target segment 211 changes to black level 3. The transition value acquisition unit 2243 also gets the transition value (black level 3) resulting from applying a pulse when the current value is black level 2 and the target value is black level 3 from the lookup table LUT, and the current value updating unit 2244 updates the current value (black level 2) of the target segment 211 stored in RAM 225 to the transition value (black level 3).

The value determination unit 2241 then gets the new current value (black level 3) of the target segment 211 from RAM 225 (step S02), and compares this current value and the target value (black level 3). The value determination unit 2241 thus determines that the current value (black level 3) and the target value (black level 3) match, and ends the color changing process.

The operation of the color changing process is described in this example using a current value of black level 1 and a target value of black level 3, but it will be apparent that a pulse to white will be applied if the target value is white level 6 and steps S02 to S08 will repeat four times, but the process is otherwise the same.

The timepiece 1 according to this aspect of the invention provides the following benefits.

The pulse application means 224 of the control circuit board 22 applies a pulse to change the display color to black or to white and then updates the current value of the target segment 211 until the current gray level (current value) of the target segment 211 for which the color is being changed matches the target value set by the target value setting means 223. More specifically, the value determination unit 2241 of the pulse application means 224 compares the target value and the current value, and if the values do not match the pulse application unit 2242 applies one pulse to effect a change either to black or to white so that the current value approaches the target value. The transition value acquisition unit 2243 then gets the gray level (transition value) that results from applying the pulse from the color transition information lookup table LUT stored in flash memory 226, and the current value updating unit 2244 updates the current value to the transition value. The pulse application means 224 repeats this process until the current value and the target value match.

Because the transition value acquisition unit 2243 gets the gray level that will be displayed after a pulse is applied by the pulse application unit 2242 from the lookup table LUT, the gray level achieved by applying a pulse can be appropriately acquired and the current value can be updated even when the gray level of the target segment 211 changes abruptly. For example, if one pulse to white is applied to a segment 211 displaying white level 1, the transition value after applying the pulse will be white level 3, and the current value of the segment 211 after the pulse is applied can be suitably updated. Because pulses are applied until the current value reaches the target value while determining based on the current value whether applying a pulse is necessary, the display color can be changed using a simpler process than when the number of required pulses is determined before applying any pulses, and the gray level of the target segment 211 can be desirably driven to the target value. A gray scale display can thus be driven suitably by means of a simple process.

Each time the pulse application unit 2242 applies one pulse to white or to black, the transition value acquisition unit 2243 gets the transition value from the lookup table LUT, and the current value updating unit 2244 updates the current value to this transition value. As a result, if the user presses a button 33 to switch the display mode, for example, so that the display content of the display panel 21 is changed while the color changing process is executing, the target value setting means 223 can change the target value of the target segment 211 according to the display content so that the color of the target segment 211 can be changed (the gray level can be changed) to quickly reach the target value without requiring a complicated control process. The processing time of the color changing process can therefore be shorted, the response of the display device 2 can be improved, and power consumption can be reduced.

In addition, when a different display panel 21 is used in the display device 2, for example, the gray level information for each segment 211 in the display panel 21 can be updated according to the specifications of the new display panel 21 by simply changing the content of the lookup table LUT stored in flash memory 226. Compatibility with different display panels 21 is thus afforded, and the utility of the display device 2 and therefore the timepiece 1 can be improved.

Furthermore, by storing the display color transition information as a lookup table LUT containing the gray level reached when one pulse to black or to white is applied to a segment 211 in a known display state, the gray level that will be changed to from the current value can be quickly and appropriately acquired. Response can therefore be improved when changing the gray level, processing time can be shortened, and power consumption can be further reduced.

The direction of change from the current value to the target value can also be easily determined because the gray levels from which the current value is selected are listed on the vertical axis and the gray levels selected as the target value are listed on the horizontal axis. A pulse in the correct direction can therefore be applied to the segment electrode SEG connected to the target segment 211.

The lookup table LUT contains as the transition values the gray level that will result when one pulse toward white is applied and when one pulse toward black is applied to a segment 211 displaying a particular gray level. Pulses can therefore be applied to the target segment 211 one pulse at a time so that the gray level to be displayed by the target segment 211 can be reached using the smallest number of pulses. The gray level of the segment 211 can thus be controlled precisely.

The target value setting means 223 sets as the target values the gray levels (white level 6, black level 1, black level 3, and black level 6) that can be achieved by pulses applied to effect a change to black and to white. The need for complicated gray level control, such as applying a pulse to black and then applying a pulse to white, or applying a pulse to white and then applying a pulse to black, can therefore be avoided. As a result, the target segment 211 can be controlled to substantially the same gray level whether the display is changed toward black or toward white. The desired gray scale display can therefore be easily achieved.

5. Variations of the Invention

The invention is not limited to the foregoing embodiment of the invention, and variations and improvements achieving the object of the invention are included in the scope of the invention.

For example, the target value setting means 223 sets gray levels (white level 6, black level 1, black level 3, and black level 6) corresponding to the color density levels that can be displayed by applying pulses toward black and toward white as the target value, but the invention is not so limited. More specifically, any gray level that can be displayed by the segments 211 of the display panel 21 can be set as the target value. In this case a specific number of pulses can be applied in one direction and pulses in the other direction can then be applied. For example, if the current value is black level 3 and the target value is black level 2, one pulse toward white can be applied to reach black level 1, and then one pulse toward black can be applied to display black level 2.

The color transition information stored in the flash memory 226 in this aspect of the invention is stored as a lookup table LUT containing the current value and the transition value representing the gray level that will be displayed when one positive or negative pulse is applied to a segment 211 in the display state corresponding to the current value, but the invention is not so limited. More specifically, the color transition information can be stored as a function of a [the aforementioned, sic] displacement curve instead of as a lookup table.

Further alternatively, the color transition information can be stored based on the voltage applied to the common electrode COM and segment electrode SEG, or using some other parameter. Examples of such parameters include the ambient humidity and the ambient temperature of the display device 2.

The lookup table LUT used for the color transition information in this aspect of the invention correlates the transition value when one positive or negative pulse is applied to a segment 211 in a particular display state to the current value representing the display state before the pulse is applied, but the invention is not so limited. For example, the transition values correlated to the current value could be achieved by applying a plurality of pulses.

The two types of electrophoretic particles contained in the microcapsules 212 in the segments 211 of the display panel 21 are negatively charged white particles 212W and positively charged black particles 212B in this aspect of the invention, but the invention is not so limited. The white particles 212W could be positively charged and the black particles 212B could be negatively charged, for example. The two types of particles can also be different colors, and particles of the desired colors can be used as needed.

Positive pulses are used as pulses changing the segment towards black and negative pulses are used as pulses changing toward white, but the invention is not so limited. More specifically, the positive pulses and negative pulses applied to the segments can be set appropriately according to the charged state of the particles in the microcapsules used in the segments.

The timepiece 1 according to a preferred embodiment of the invention is rendered using a display device 2 having a monochrome display containing white particles 212W and black particles 212B, but the invention is not so limited. A color display can be achieved, for example, by rendering the segments 211 small and providing a color filter at the position of each segment 211. A color display can also be rendered by filling the microcapsules 212 of each segment 211 with particles of two different colors and color saturation levels, and controlling the pulses applied to the microcapsules 212 to display the desired color. The color particles could be red (R), green (G), or blue (B) with some of the particles being dark and some light, for example.

A timepiece 1 rendered as a wristwatch is described above as the device having the display device 2 of the invention, but the invention is not so limited. The display device 2 of the invention can be used in a wall clock, for example. The device having the display device 2 of the invention is also not limited to a timepiece. The invention can be used in an image display device such as a monitor, for example.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

The entire disclosure of Japanese Patent Application No. 2006-173412, filed Jun. 23, 2006 is expressly Incorporated by reference herein.

What is claimed is:

1. A display device comprising:

an electrophoretic display panel that has two types of electrophoretic elements of different color and polarity disposed between electrodes, and that changes display state according to an applied voltage in a first direction from a first color to a second color and a second direction from the second color to the first color; and drive means for driving the electrophoretic display panel by applying a voltage between the electrodes, the drive means including storage means for storing color transition information correlating the color levels displayed by the electrophoretic elements to a positive voltage color level that is displayed when a positive voltage pulse is applied and a negative voltage color level that is displayed when a negative voltage pulse is applied to the electrode connected to the electrophoretic elements displaying a particular color level, target value setting means for setting a target value of a target color to be displayed by the electrophoretic elements, the color transition information denoting how many of one of positive or negative voltage pulses are needed to change from a first color to the target color, the target color being selected from selectable target colors which are prescribed for the display device to display, the number of the selectable target colors being less than the number of the displayable colors, the selectable target colors including at least a first selectable target color as the target color is substantially equal to the negative voltage color level to attain the first selectable target color as the target color, and pulse applying means for applying one of a positive or negative voltage pulse of a specific voltage level to the electrodes from a current color with a current value to the target color, the pulse applying means including a value determination unit for determining if the current value and the target value match, a pulse application unit for applying either a positive voltage pulse or a negative voltage pulse to the electrode on the basis of the color transition information when the current color is the first color so that the current value approaches the target value when the value determination unit determines the current value and the target value do not match, a transition value acquisition unit for getting from the color transition information a transition value denoting a color level after the pulse is applied, a current value updating unit for updating the current value to the transition value, the target value being substantially same color in both the first and second directions.

2. The display device described in claim 1, wherein the color transition information is stored in the storage means as a table correlating a plurality of color levels that are displayed by the electrophoretic display panel, and the transition value that results when either a positive pulse or a negative pulse is applied to the electrode connected to the two types of electrophoretic elements at each of the plural color levels.

3. The display device described in claim 2, wherein the color transition information is stored in the storage means as a table having the plurality of color levels set on one axis and the target values and the color levels that are displayed by the electrophoretic elements set on the other axis, and the transition values are set to the color level that is displayed when either one positive pulse or one negative pulse is applied to the electrode connected to electrophoretic elements in the display state of the current value.

4. The display device described in claim 1, wherein the target value setting means sets the target value to a color level which is attained either by increasing or decreasing the color level.

5. The display device described in claim 1, wherein the two types of electrophoretic elements are color particles of different saturation levels, and the color level is a gradation level of saturation that can be expressed by the color particles.

6. A timepiece comprising:

the display device described in any one of claims 1 to 5; and a case for holding the display device.

7. The display device described in claim 1, wherein the number of the selectable colors is four, and the number of the displayable colors is twelve.

* * * * *